US010337166B2

(12) United States Patent
Rohou

(10) Patent No.: US 10,337,166 B2
(45) Date of Patent: Jul. 2, 2019

(54) FRONT-LOADER ARRANGEMENT

(75) Inventor: David Rohou, Pouldreuzic (FR)

(73) Assignee: DEERE & COMPANY, Moline, IL (US)

( * ) Notice: Subject to any disclaimer, the term of this patent is extended or adjusted under 35 U.S.C. 154(b) by 1418 days.

(21) Appl. No.: 13/187,799

(22) Filed: Jul. 21, 2011

(65) Prior Publication Data

US 2012/0027551 A1 Feb. 2, 2012

(30) Foreign Application Priority Data

Jul. 27, 2010 (DE) ..... 10 2010 038 469

(51) Int. Cl.
*E02F 3/627* (2006.01)
*E02F 3/36* (2006.01)

(52) U.S. Cl.
CPC ..... *E02F 3/627* (2013.01); *E02F 3/3645* (2013.01); *E02F 3/6276* (2013.01)

(58) Field of Classification Search
CPC ..... E02F 3/3645; E02F 3/627; E02F 3/6276
USPC ..... 37/345, 346, 403, 443, 468; 172/245–254, 272–274, 297–309, 438; 403/43, 44, 66, 68, 69, 292, 321–327, 403/330, 345–383; 414/680, 685–727, 414/912, 920
See application file for complete search history.

(56) References Cited

U.S. PATENT DOCUMENTS

| | | | | |
|---|---|---|---|---|
| 5,078,569 | A * | 1/1992 | Cook | 414/723 |
| 5,466,113 | A * | 11/1995 | Norberg | 414/723 |
| 6,142,724 | A * | 11/2000 | Hirooka et al. | 414/686 |
| 7,530,779 | B2 | 5/2009 | Holloway et al. | |
| 2004/0228716 | A1 * | 11/2004 | Perrin et al. | 414/723 |
| 2011/0262256 | A1 * | 10/2011 | Griffiths et al. | 414/686 |

FOREIGN PATENT DOCUMENTS

| | | |
|---|---|---|
| AT | 374857 | 8/2004 |
| DE | 7430734 | 3/1975 |

* cited by examiner

*Primary Examiner* — Ronald P Jarrett

(57) ABSTRACT

A front-loader arrangement (12) for an agricultural vehicle (10) with a bracket (16) and a mast arrangement (18) for fastening a front loader (13) to the bracket (16). The mast arrangement (18) comprises a contact point (53) for application onto a bearing point (36) of the bracket (16) and a displaceable locking element (54) that extends through at least one first opening (52, 52A) formed on the mast arrangement (18) and through at least one second opening (38) brought into alignment with the first opening (52, 52A). The locking element (54) is connected by a connection element (56) to an actuation element (58) arranged offset parallel to the locking element (54). The actuation element (58) can be actuated by an external force and the locking element (54) can be displaced by the connection element (56) and by the actuation of the actuation element (58) from the unlocked position into the locked position.

6 Claims, 10 Drawing Sheets

FRONT-LOADER ARRANGEMENT

FIELD OF THE INVENTION

The invention relates to a front-loader arrangement for an agricultural vehicle with a bracket and a mast arrangement for fastening a front loader to the bracket.

BACKGROUND OF THE INVENTION

Front-loader arrangements, i.e., the arrangement of a front loader on a vehicle, especially on an agricultural vehicle, or also on a different type of utility vehicle, are known. Thus, front loaders can be attached to or mounted on a vehicle, for example, a tractor or an agricultural tractor, by means of a mounting frame or bracket, in order to carry out loading work. The mounting frame or the bracket is typically screwed onto the vehicle frame or is fastened to this vehicle frame. The front loader itself provides an attachment or mounting point or mast arrangement that is attached or mounted or hinged to the bracket. In this respect, different possibilities are known. Thus, some known embodiments for front-loader arrangements have mechanisms that provide two hooks that are formed on the bracket and are used for the reception of two bearing bolts formed on the mast arrangement of the front loader, wherein at least one of the hooks is locked after the reception of the bearing bolt. The reception of the bearing bolt is here realized by guiding the bracket or driving the vehicle onto the mast arrangement or onto the front loader that is located in a corresponding park position or mounting position. After reception of the bearing bolt, the locking of the hook can be performed manually or also semi-automatically or fully automatically or by an external motor or by remote control. Other mechanisms provide that the bracket has only one hook that is used for the reception of one bearing bolt formed on the mast arrangement. For locking, furthermore, on each of the bracket and mast arrangement, connection openings are formed that are connected to each other by means of a locking bolt or through which a locking bolt is guided. Also here, the locking can be performed manually or also semi-automatically or fully automatically or by an external motor or by remote control.

Such semi-automated locking is disclosed in US 2007/0059147A1, in which a front-loader arrangement is proposed that comprises a spring-biased locking bolt that can be actuated by means of actuation elements formed on a mast arrangement and on a bracket, in that the actuation elements trigger a locking through movement relative to each other, such that the locking bolt is guided through spring force into connection openings formed on the mast arrangement and on the bracket of the front-loader arrangement. For the unlocking, the locking bolt must be guided manually out from the connection openings against the spring force and the actuation elements are brought into a corresponding unlocked position. It is disadvantageous here that, in particular, the formation and arrangement of the actuation element formed on the mast arrangement, as well as its connection to the locking bolt, require relatively complex production and assembly efforts.

SUMMARY OF THE INVENTION

According to the invention, a front-loader arrangement of the type named above is formed such that the locking element is connected, advantageously rigidly, by means of a connection element to an actuation element arranged offset parallel to the locking element, wherein the actuation element can be actuated by an external force and the locking element can be displaced by means of the connection element and by actuation of the actuation element out from the unlocked position into the locked position. Through the arrangement of an actuation element in connection with a connection element that functions as a kind of bridge between the actuation element and the locking element, the locking element can be formed in an uncomplicated and simple way and can be supported on the mast arrangement. A connection element that can have a similarly uncomplicated and simple construction, for example, a connection plate, a connection rod, a connection bar, a connection tube, etc., allows the indirect actuation of the locking element by an external force, for example, by a spring force or by a connected hydraulic, pneumatic, electric, or mechanical actuator, wherein the locking element is carried along by means of the connection element when the actuation element is actuated or displaced or moved. The external force acting on the actuation element can be transmitted onto the locking element and can act on this locking element. The geometric dimensions of the actuation element can be constructed arbitrarily, so that also here a simpler and more compact construction is aided, because, with respect to other actuation means or actuation elements required for actuation, they are not bound directly to the relatively large dimensions of a locking element.

The actuation element and the locking element are supported or guided displaceably on the mast arrangement, wherein the locking element is displaced, guided parallel, when the actuation element is displaced together with the actuation element. The mast arrangement is formed by two mirror-inverted plates that lie opposite each other and are connected to each other by means of one or more cross-pieces. The mentioned displaceable support of the actuation bolt could be performed, for example, by means of recesses formed opposite each other on the two plates, wherein the actuation element can extend through or is guided into these recesses. The typically robust formation of a locking element on a front loader also allows a correspondingly robust support or guidance of the locking element that can absorb relatively large bearing forces. Accordingly, the guidance or support of the actuation element can turn out to be relatively simple and uncomplicated, because the large part of the forces acting on the actuation element is absorbed by the rigid connection between locking, connection, and actuation elements from the guidance or support formed for the locking element.

As an external force, a force triggered or applied by a spring is provided with which the actuation element can be acted upon or actuated. Alternatively, other actuation forms are also conceivable by means of external force. Thus, the actuation element can be connected, for example, to an actuator that can be actuated hydraulically, electrically, pneumatically, or also electromechanically and exerts an actuation force on the actuation element. Actuators that could be used are, for example, hydraulic cylinder, pneumatic cylinder, stepper motors, spindle motors, or other types of electric motors.

The front-loader arrangement comprises a latching device with which the actuation element can be latched in the unlocked position. In the unlocked position, the actuation element is biased or acted upon with the force named above for actuation such that it is brought into the locked position as soon as the latching is detached. On the other hand, the latching is performed automatically as soon as the actuation element is brought out from the locked position into the unlocked position.

The latching device can comprise a latching lever that is supported on the mast arrangement and can be forced or is biased by another or second spring into a latched position in which the latching lever can be brought into engagement in the unlocked position with a shoulder formed on the actuation element. The latching lever here has an actuation face that can be brought into engagement with the bracket such that the latching lever is moved against the spring force of the second spring out from the latched position. The latching lever is arranged such that, for attachment of the front loader or the mast arrangement onto the vehicle or onto the bracket, the latching lever is activated by a contact with the bracket or with a part connected to this bracket, so that the latching is detached automatically. The latching lever could be formed as a rocking lever or tilting lever or swinging lever, wherein, at one lever end, it is connected to the spring, and at the other lever end, it can be brought into engagement with the bracket.

The spring for actuation of the actuation element could be formed, for example, as a coil spring, wherein here conical springs or truncated cone springs or also barrel springs could be used. These could be formed as tensile or compression springs.

The actuation element and the locking element are formed as round bolts, wherein these could be formed solid or also hollow as a tube or tube profile. Different than the locking element, the actuation element could also have a rectangular cross section, because it does not have to perform a rotational movement about its longitudinal axis, but instead only a translating movement or displacement (it is arranged displaceable both in the transverse direction, that is, the radial direction, and also in the longitudinal direction, but cannot rotate about its longitudinal axis). In contrast, the locking element can experience a rotating movement (about its longitudinal axis) and also a translating movement (in the direction of its longitudinal axis).

For detaching the front loader from the bracket, the actuation element is supported displaceably in guide openings formed in the mast arrangement such that, in the unlocked position, the latching lever can be brought into engagement with the shoulder on the actuation element in a position engaged with its actuation face with the bracket. That is, when the latching lever engages with the bracket and the spring for biasing the latching lever is located in the tensioned state, then the actuation element can be displaced in the direction of the latching lever in a translating way, i.e., in the transverse direction relative to its longitudinal axis, so that the actuation element is moved in the direction of the latching lever and the latching lever can be brought into engagement with the shoulder on the actuation lever. Simultaneously, the locking element carries out the rotating movement named above, so that, for the translating displacement of the actuation element through the rigid connection between the locking and actuation element, the former is set into a rotational movement and the latter is moved in a circular path around the locking element.

With reference to the drawing that shows an embodiment of the invention, the invention and also other advantages and advantageous improvements and constructions of the invention will be described and explained in detail below.

DESCRIPTION OF THE PREFERRED EMBODIMENT

Figure 1:
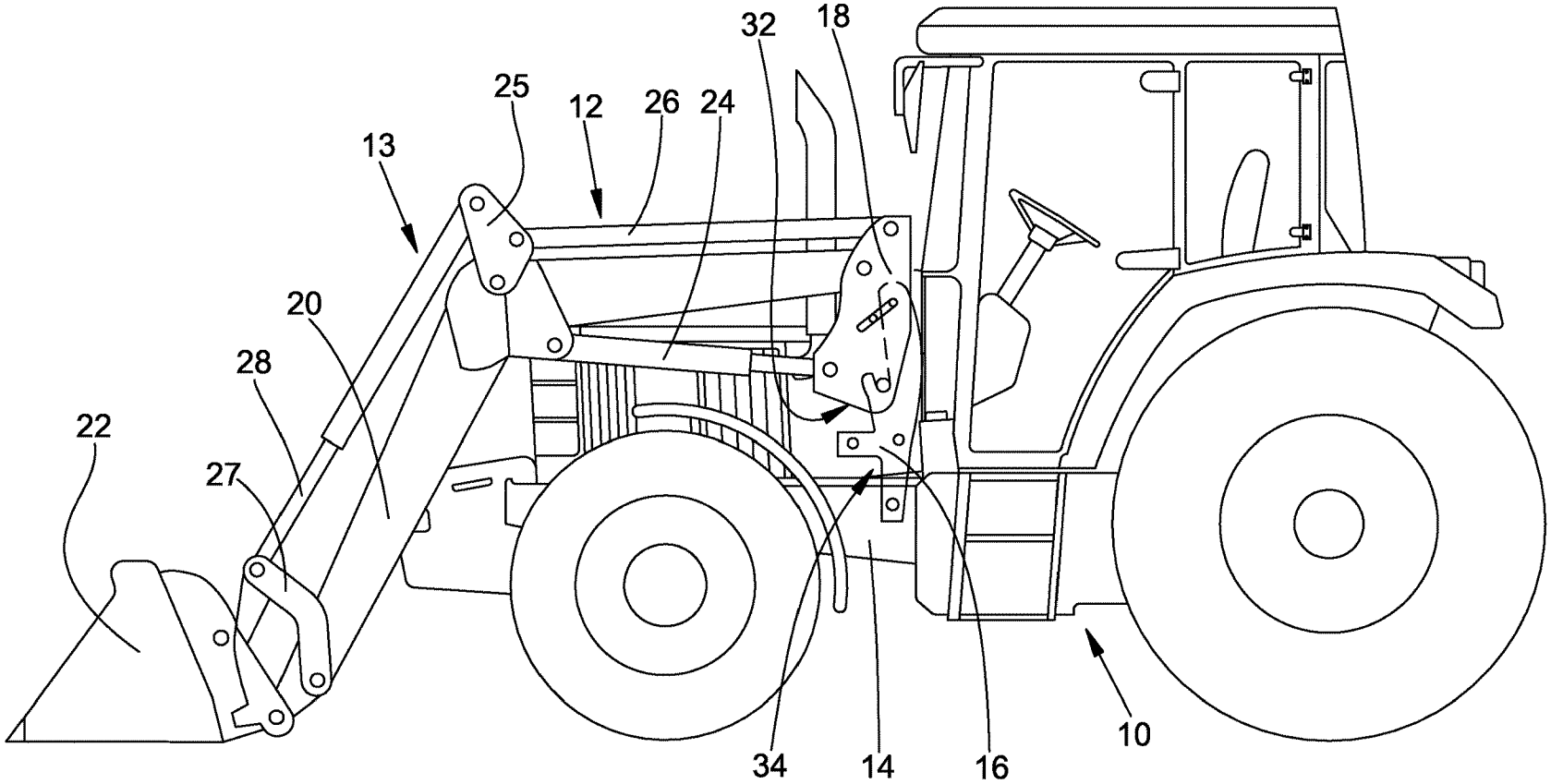
FIG. 1 is a schematic side view of a front-loader arrangement according to the invention and installed on a vehicle.

In FIG. 1, a loading vehicle in the form of an agricultural tractor is shown. The tractor 10 provides an attached front-loader arrangement 12. The front-loader arrangement 12 comprises a front loader 13, as well as a frame arrangement or bracket 16 attached to a vehicle frame 14 of the tractor 12. The front loader 13 has a mast arrangement 18 by means of which the front loader 13 is attached to the bracket 16 of the front-loader arrangement 12 on the tractor 10.

The front-loader arrangement 12 or the front loader 13 further has a front-loader link 20 that is fastened to the mast arrangement 18 so that it can pivot and to which a pivoting front-loader tool 22 attaches. The front-loader tool 22 is formed, for example, in the form of a loading bucket, wherein the front-loader tool 22 could also be constructed as a loading fork, gripper, etc. The front-loader link 20 can pivot by means of a hydraulic lifting cylinder 24 that extends between the mast arrangement 18 and the front-loader link 20. A control linkage 26 that is used for the parallel guidance of the front-loader tool 22 extends between a control rod 25 connected to the front-loader link 20 and the mast arrangement 18. The front-loader tool 22 can pivot by means of a pivot linkage 27 connected to the front-loader link 20 and the front-loader tool 22, as well as by means of a hydraulic pivoting cylinder 28 connected to the pivot linkage 27 and the control rod 25.

Figure 2A:
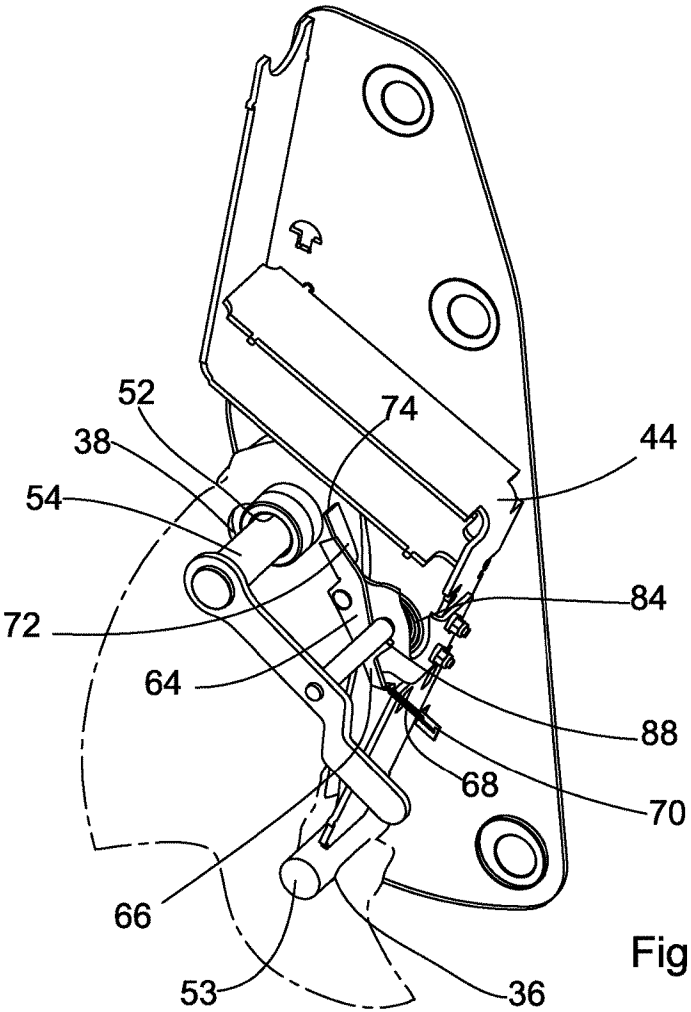
FIG. 2A is a perspective cross-sectional view of the mast arrangement of the front-loader arrangement from FIG. 1.
Figure 2:
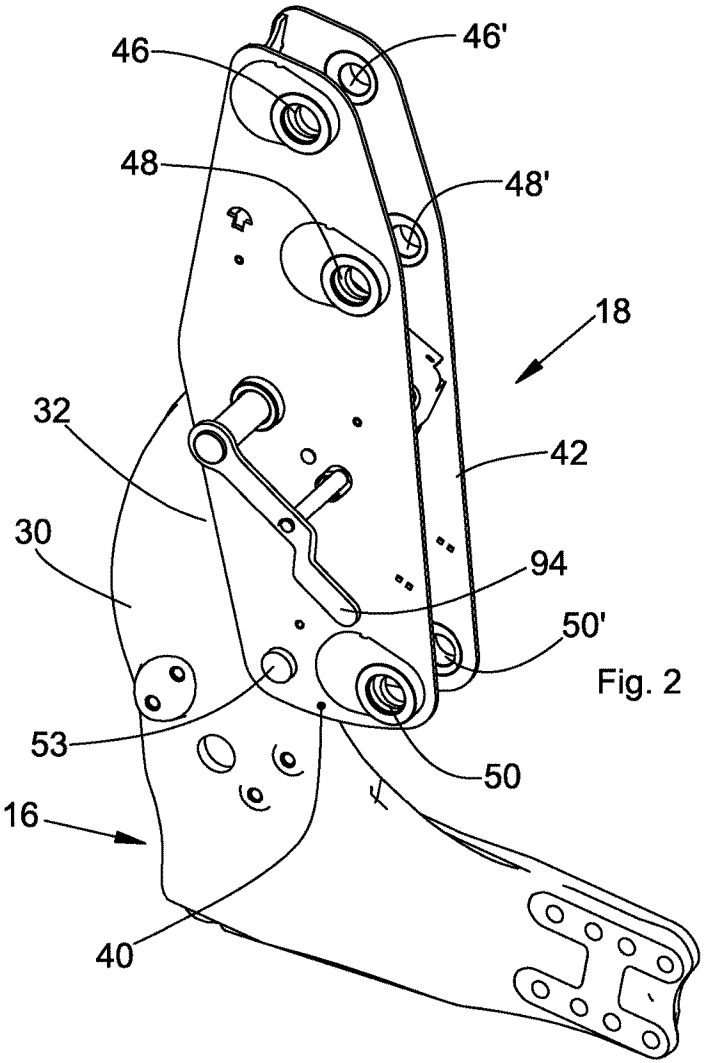
FIG. 2 is a perspective side view of a mast arrangement and bracket of the front-loader arrangement from FIG. 1.

In FIGS. 2 and 2A, the mast arrangement 18 and also the bracket 16 of the front-loader arrangement 12 are shown enlarged in a perspective side view or in a perspective cross-sectional view.

The bracket 16 is constructed as a solid frame plate 30 and has a receptacle region 32 for holding or coupling the mast arrangement 18, as well as a fastening region 34 for fastening the bracket 16 onto the vehicle frame 14. At the fastening region 34, the bracket 16 is screwed by means of screw connections (not shown) to the vehicle frame 14. On a lower region of the receptacle region 32, the bracket 16 has a hook-shaped bearing point 36, and on an upper region of the receptacle region 34, an opening 38 in the form of a bearing drill hole.

The mast arrangement 18 has a front side plate 40 and a mirror-inverted, opposing, rear side plate 42. A double-bent frame plate 44 that is used as a reinforcement and support structure extends between the side plates 40, 42. By means of the frame plate 44, the two side plates 40, 42 are connected to each other in parallel. The side plates each have an upper bearing point 46, 46', a middle bearing point 48, 48', and a lower bearing point 50, 50', wherein the control linkage 26 is hinged in a pivoting manner to the upper bearing points 46, 46', the front-loader link 20 to the middle bearing points 48, 48', and the lifting cylinder 24 to the lower bearing points 50, 50'. Furthermore, in a middle region, the side plates 40, 42 each have an opening 52, 52A in the form of a drill hole with which the mast arrangement 18 can be locked onto the opening 38 of the bracket 16, as will be described in detail farther below. Furthermore, at the height of the lower bearing points 50, 50', a contact point 53 in the form of a bearing bolt extends between the side plates 40, 42, wherein this bearing bolt is used for the contact of the mast arrangement 18 on the bearing point 36 formed on the fastening region 32 of the bracket 16. In the openings 52, 52A, there is a locking element 54 in the form of a connection bolt that is supported in the openings 52, 52A so it is displaceable in the direction of its longitudinal axis. The locking element 54 is connected rigidly by means of a connection element 56 in the form of a flat profile or flat steel to an actuation element 58 in the form of a bolt or a round steel piece or a rod. The actuation element 58 is arranged with its longitudinal axis parallel to the locking element 54. Between the side plates 40, 42, there is a latching device 59 that comprises a guide plate or retaining plate 60 extending parallel to the side plates 40, 42 and fastened to the frame plate 44. Furthermore, the latching device 59 comprises, between the retaining plate 60 and the front side plate 40, a latching lever 64 supported in a pivoting manner on a bearing bolt 62, wherein the bearing bolt 62 is arranged approximately in the middle with respect to the latching lever 64. The latching lever 64 is connected to a retaining plate 70 at a first end 66 by means of a spring 68, wherein the retaining plate 70 is fastened in the form of a bend to the front side wall 40. A second end 72 of the latching lever 64 extends in the direction of the opening 52, opposite the first end 66. At its second end 72, the latching lever 64 has an actuation face 74. As is to be seen especially in FIGS. 3 and 4, in the retaining plate 60, a guide opening 76 is formed through which a free end 78 of the actuation element 58 is guided. The actuation element further extends through corresponding passage openings 77, 77' in the side plates 40, 42 that are constructed such that unimpaired movement of the actuation element 58 is enabled. The other end of the actuation element is here connected rigidly to the connection element 56, advantageously welded or screwed. At the free end 78 of the actuation element 58, a threaded bolt 80 is provided with a bolt head 82. Between the bolt head 82 and the retaining plate 60, a spring 84 is tensioned, wherein the spring 84 is constructed as a conical or truncated cone-shaped compression spring. At the free end 78 of the actuation element 58, in the frame of the latching device 59, a shoulder 86 is constructed that can be brought into engagement with a recess 88 constructed on the first end 66 of the latching lever 64. The guide opening 76 is constructed as an elongated drill hole, wherein the elongated drill hole has an upper region 90 with a first diameter and a lower region 92 with a smaller second diameter, wherein the first diameter corresponds approximately to the normal cross-sectional dimension of the actuation element 58 and the second diameter corresponds approximately to the cross-sectional dimension of the actuation element 58 at the shoulder 86, so that, in the lower region 92, due to the smaller second diameter, a guidance of the actuation element 58 on its shoulder 86 or on its free end 78 can be realized, as is still to be described below.

Figure 3:
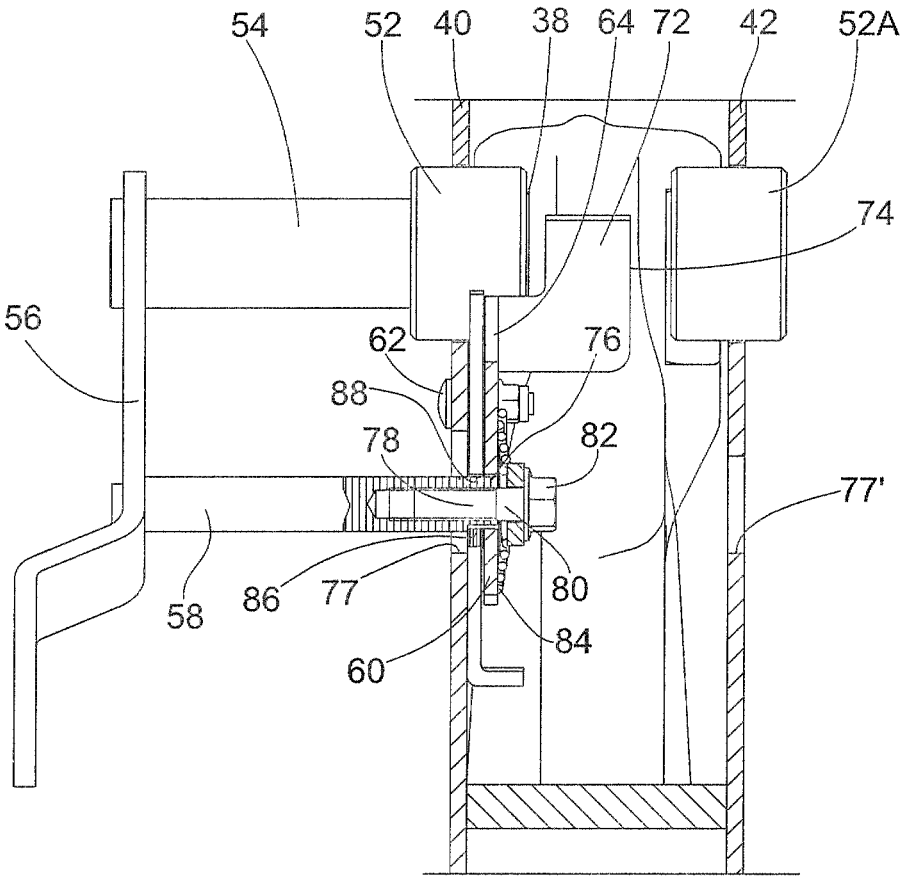
FIG. 3 is a cutout of the mast arrangement according to FIG. 2 in a cross-sectional view from the front in an unlocked position.

In FIG. 3, the actuation element 58 is shown in an unlocked position in which the latching lever 64 is engaged with the shoulder 86 of the actuation element 58 and holds the actuation element 58 in this position against an actuation force applied by the spring 84.

Figure 4:
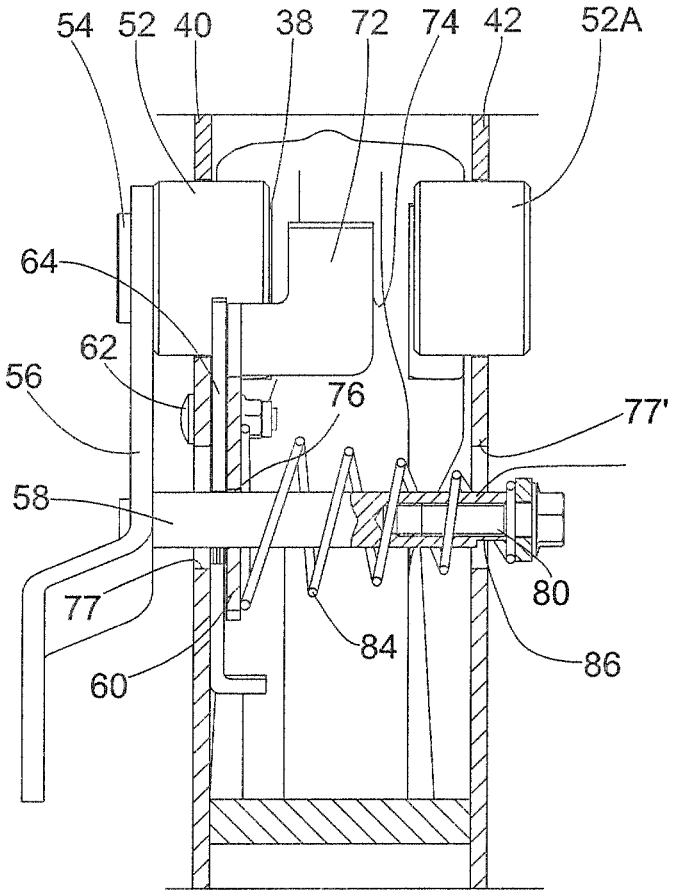
FIG. 4 is a cutout of the mast arrangement according to FIG. 2 in a cross-sectional view from the front in a locked position.

In FIG. 4, the actuation element 58 is shown in a locked position after the latching lever 64 was actuated (with respect to FIG. 2 rotated in the clockwise direction about the bearing bolt 62) or after the engagement of the latching lever 64 on the shoulder 86 of the actuation elements 58 was released or after the latching previously performed by the latching lever 64 was detached, so that the actuation element 58 was displaced by the actuation force applied by the spring 84. Through the rigid connection produced by means of the connection element 56 between actuation element 58 and locking element 54, the latter was correspondingly also displaced and brought into its locked position in which it extends through the previously oriented and aligned openings 52, 38, and 52A. Due to the actuation force applied by the spring 84, the actuation element 58 and thus also the locking element are held in the locked position according to FIG. 4.

For unlocking the locking elements 54 or for bringing the locking elements 54 into the unlocked position, a handle-like projection 94 is provided on the connection element 56, wherein, by means of this projection, a pulling force acting against the actuation force of the spring 84 can be applied or the locking element 54 can be moved out from the openings 52, 38 and 52A.

It should be noted that the description stated above and the drawing with the associated reference symbols relates to one side of the front-loader arrangement 12, wherein a corresponding explanation is also provided, mirror-inverted, for the other side of the front-loader arrangement 12. The same applies to the following explanations.

Figure 5:
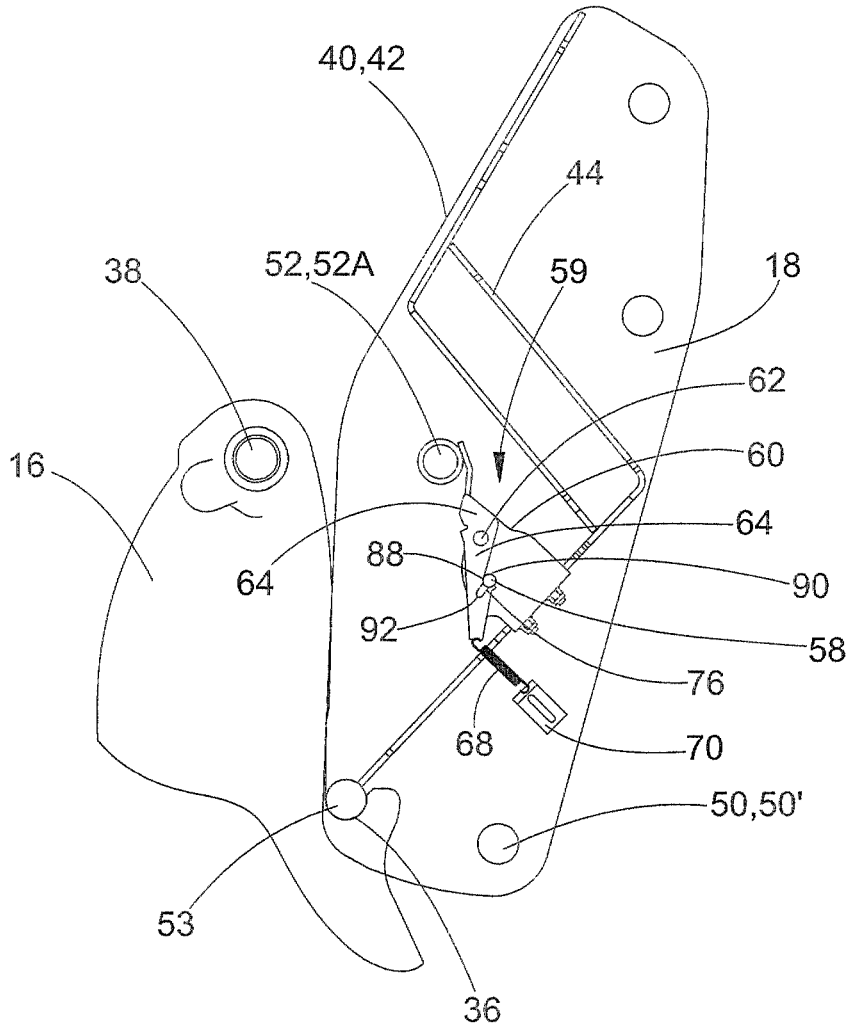
FIG. 5 is a schematic side view of the mast arrangement according to FIG. 2 for an attachment process of the mast arrangement onto the bracket in the unlocked position.
Figure 6:
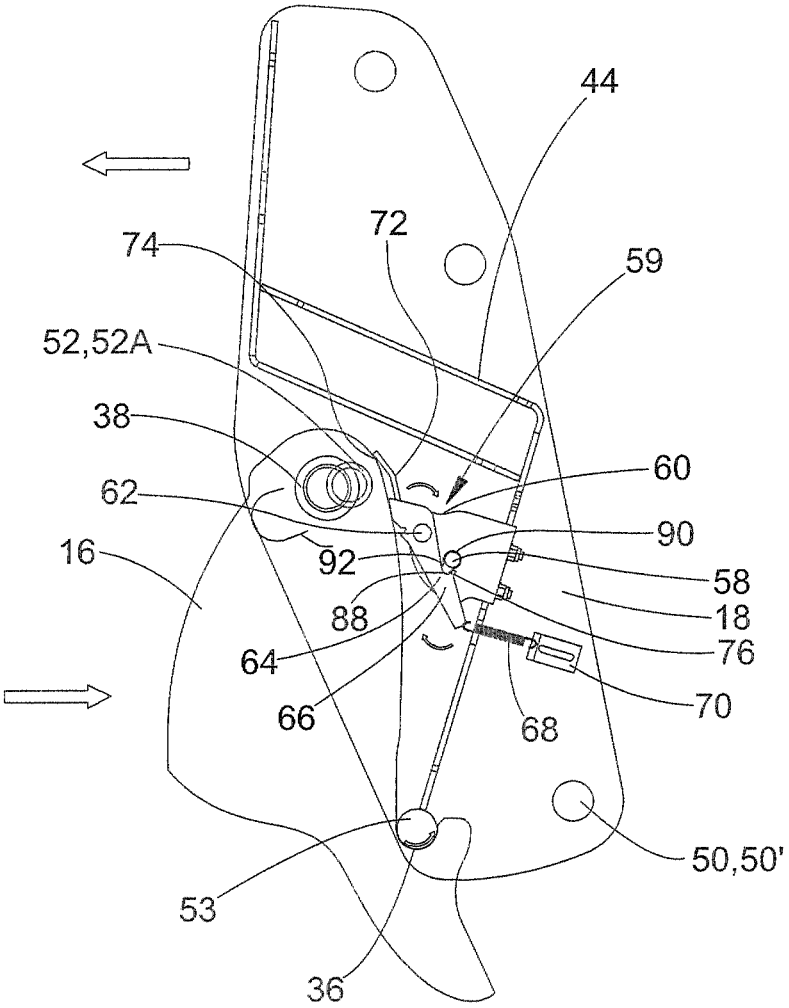
FIG. 6 is another schematic side view of the mast arrangement according to FIG. 2 during the attachment process of the mast arrangement onto the bracket in an intermediate position.
Figure 7:
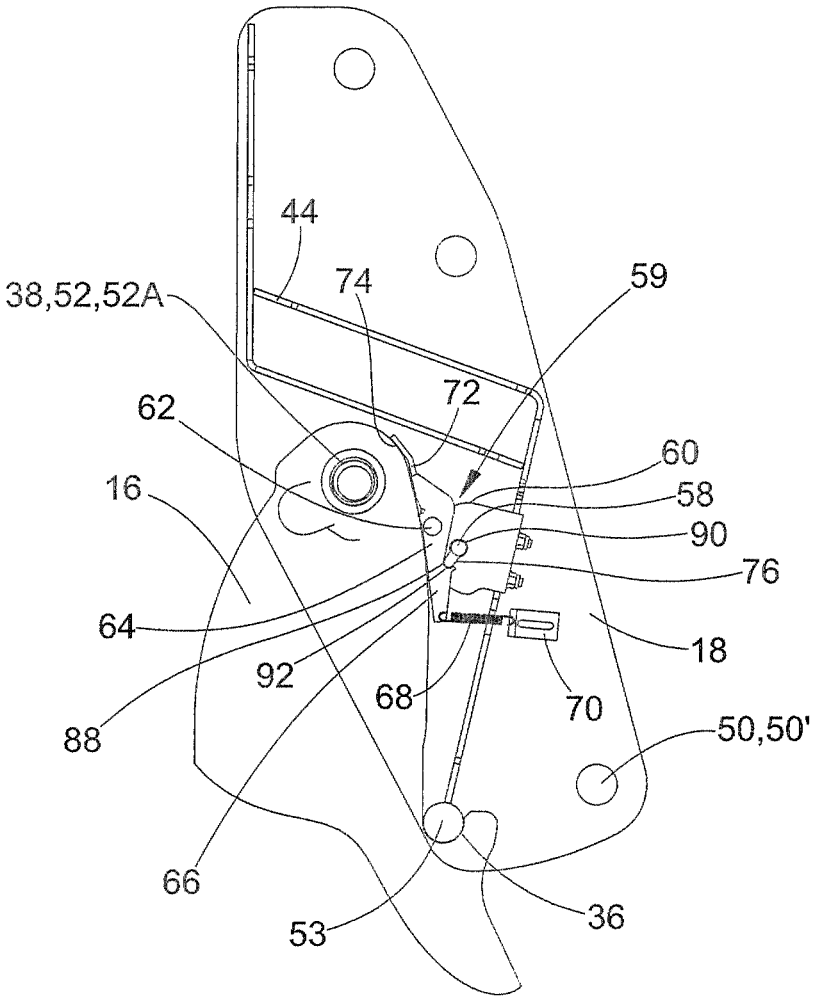
FIG. 7 is another schematic side view of the mast arrangement according to FIG. 2 after the attachment process of the mast arrangement onto the bracket in the locked position.

The functioning of the latching device 59, as well as the locking and unlocking of the locking element 54, for the attachment and detachment of the front loader 13 to and from the bracket 16 will be described with reference to the following FIGS. 5 to 10 as follows:

For attachment of the front loader 13, the vehicle 10 together with the bracket 16 is brought onto the mast mechanism 18 of the parked front-loader arrangement 12, wherein the bearing point 36 is brought into engagement with the contact point 53 (FIG. 5). The latter can be achieved, for example, by moving the front loader 12 by means of a previously connected front loader hydraulic mechanism and/or by driving the vehicle 10 up to it. The latching device 59 is located in a latched state, wherein the locking element 54 is located in the unlocked position and the latching lever 64 is engaged with the shoulder 86 of the actuation element 58 or the latching lever 64 is held by the actuation force of the spring 68 in a latched position and blocks the actuation element 58. Through movement of the front loader 12 (indicated by the arrows), whether it is by the vehicle 10 or by means of a connected front loader hydraulic mechanism (not shown) or by actuation of the lifting cylinder 24, the mast arrangement 18 now begins to carry out a pivoting movement about the contact point 53 (in FIG. 6 in the counterclockwise direction), through which the openings 52, 52A in the mast arrangement are moved in the direction of the opening 38 in the bracket 16. The bracket 16 and the latching lever 64 are arranged tuned to each other such that the bracket 16 comes into engagement with the actuation face 74 and sets the latching lever 64 into a pivoting movement with which the latching lever 64 rotates in the clockwise direction (see FIG. 6) against the actuation force of the spring 68 about the bearing bolt 62. With increasing pivoting movement, the engagement of the latching bolt 64 in the shoulder 86 decreases until finally the latching is detached and the actuation element 58 is released. The actuation element 58 biased by the spring 84 then begins to move the locking element 54 connected to it into the opening 52 through the actuation force of the spring 84. As soon as the pivoting movement of the mast arrangement 18 is advanced such that the openings 52, 38 and 52A overlap or are aligned, through the continuing actuation force of the spring 86, the locking element 54 is pulled completely into the mentioned openings 52, 38, 52A, so that the front-loader arrangement 12 is locked and the locked position is assumed. During this process, the bracket 16 is further engaged with the latching lever 64 that comes in contact on the bracket at the end of the pivoting movement of the mast arrangement 18 (FIG. 7), wherein the actuation force of the spring 68 has also reached a maximum.

Figure 8:
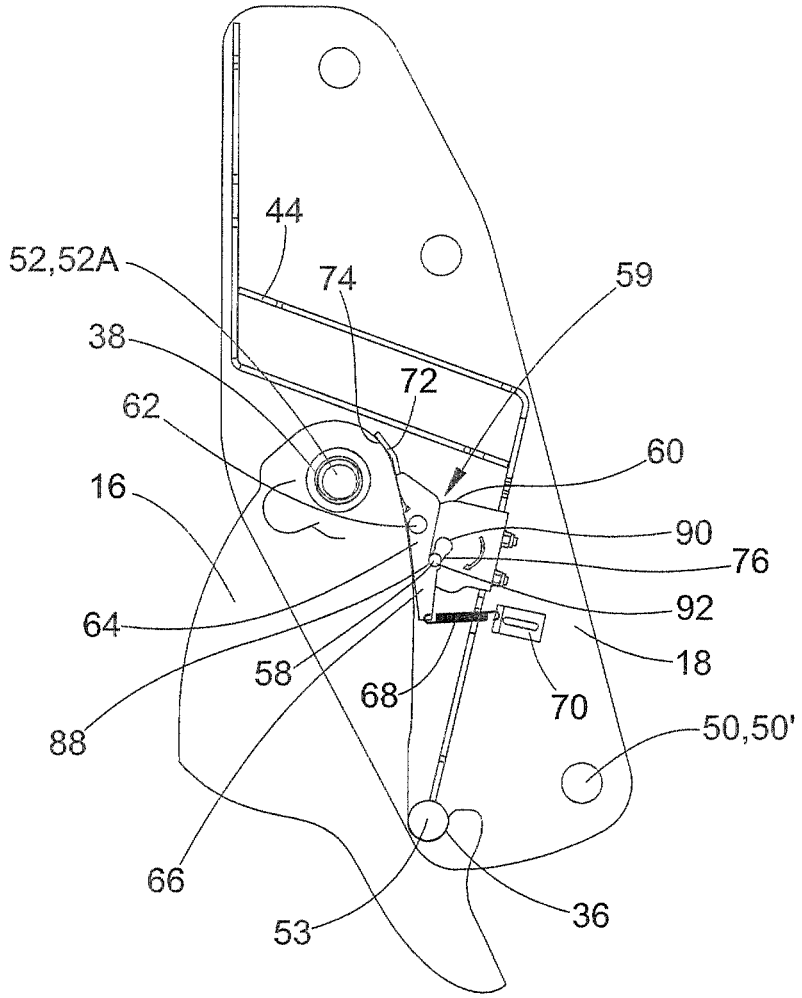
FIG. 8 is a schematic side view of the mast arrangement according to FIG. 2 during the disassembly process of the mast arrangement from the bracket in a first intermediate position.
Figure 9:
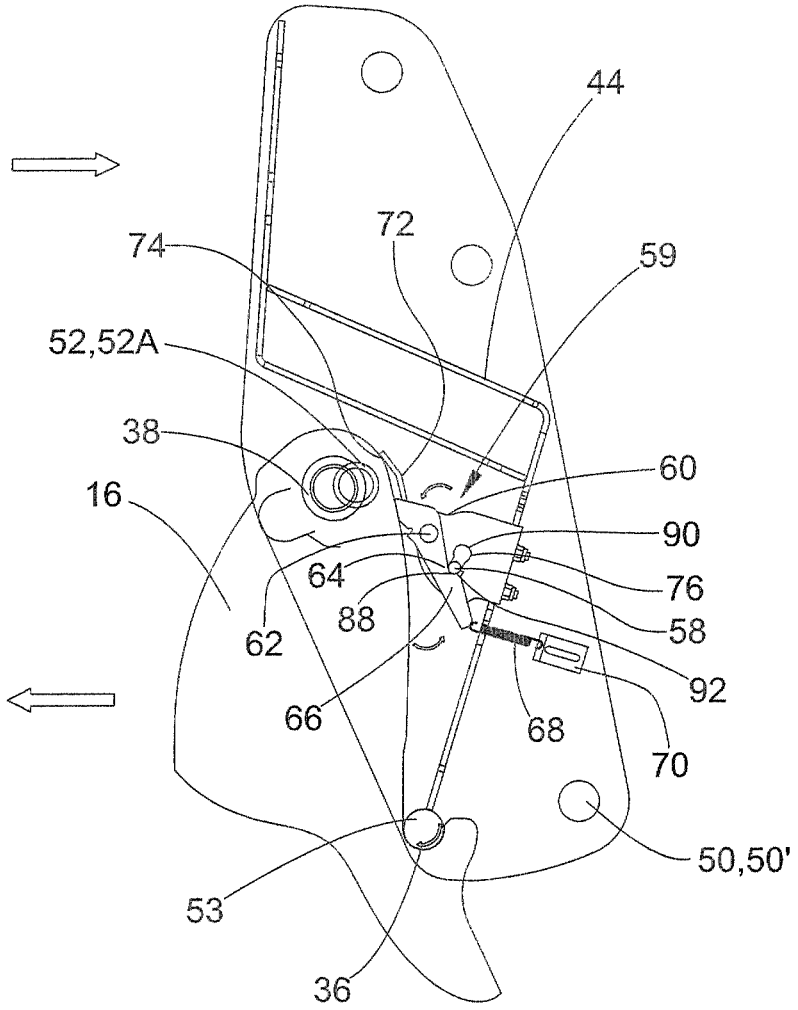
FIG. 9 is another schematic side view of the mast arrangement according to FIG. 2 during the disassembly process of the mast arrangement from the bracket in a second intermediate position.
Figure 10:
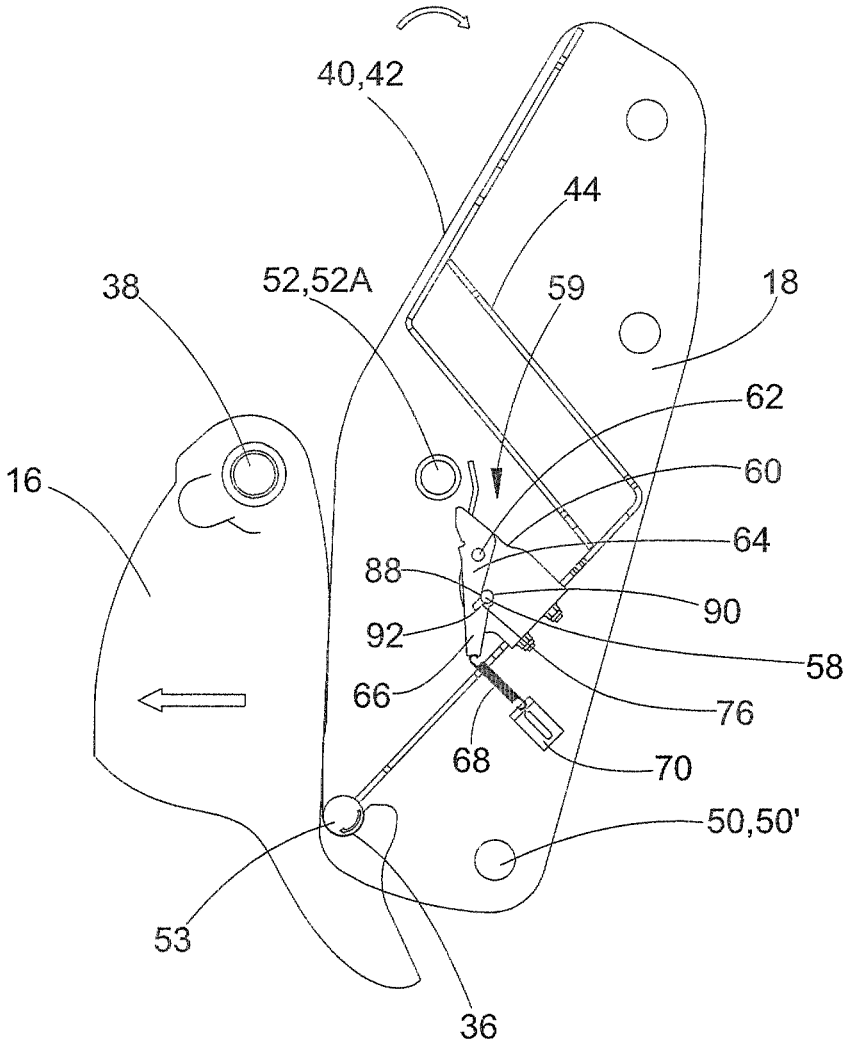
FIG. 10 is another schematic side view of the mast arrangement according to FIG. 2 during the disassembly process of the mast arrangement from the bracket in the unlocked position.

For detachment of the front loader 13, the locking element must be brought out from its locked position into the unlocked position, wherein this is performed manually, in that the locking element 54 is pulled out from the openings 52, 38, 52A, latched again and then the vehicle 10 is moved away from the front loader 13. Through gripping or actuation of the handle-like projection 94, the locking element 54 can be pulled out from the openings 52, 38, 52A against the actuation force of the spring 84 and the openings 52, 38, 52A can be unlocked accordingly. In order to latch this unlocked position of the locking elements 54, the handle-like projection 94 is moved downward, by means of which the locking element 54 experiences a rotational movement in the clockwise direction. Here it is to be taken into account that when the locking element 58 is pulled out, the actuation element 54 was displaced together with the locking element 58 and the shoulder 86 of the actuation element 58 was moved back into a position that can engage with the latching lever 64. Through the rotational movement, the actuation element 58 is now displaced in the region of the projection 86 along the guide opening 76 in the region of the smaller diameter 92 in the transverse direction until the shoulder 86 comes into contact on the latching lever 64 or the latching lever 64 engages with the shoulder 86. The actuation element 58 is here moved on a circular path about the rotational axis of the locking element 54. As soon as the latching lever 64 has been brought into engagement with the shoulder 86 of the actuation element 58, the actuation element 58 is held in this engaged position by the actuation force of the spring 84 (FIG. 8). The vehicle can now be moved away from the front loader 13 after unlocking the openings 52, 38, 52A, by means of which the bracket 16 begins to release the actuation face 74 of the latching lever 64 (FIG. 9). Simultaneously, the actuation force of the spring 68 forces the latching lever 64 into the latched position and causes a reverse pivoting movement of the latching lever 64 (counterclockwise direction), by means of which the actuation element 58 is moved back upward along the guide opening 76, wherein the latter is accordingly accompanied by a rotational movement of the locking element 54 in the direction opposite that above. Simultaneously, the mast arrangement 18 also begins to pivot back in the clockwise direction about the contact point 53 (FIG. 9, see arrows). Through further removal of the bracket 16 from the mast arrangement 18, the reverse pivoting movement of the mast arrangement 18 is continued about the contact point 53 until finally the engagement of the bracket 16 on the actuation face 74 of the latching lever 64 is cancelled and the latching lever 64 as well as the actuation element 58 and thus also the locking element 54 have again assumed the complete unlocked position according to FIG. 5 (see FIG. 10). The contact point 53 can now be separated from the bearing point 36 by movement of the front loader 12 by means of the front loader hydraulic mechanism and the front loader 12 is parked or stopped.

The invention claimed is:

1. Front-loader arrangement (12) for an agricultural vehicle (10) with a bracket (16) and a mast arrangement (18) for fastening a front loader (13) onto the bracket (16), comprising: a contact point (53) for application onto a bearing point (36) of the bracket (16) and a displaceable locking element (54) having a longitudinal axis and that can be displaced longitudinally from an unlocked position into a locked position in which the locking element (54) extends through at least one first opening (52, 52A) formed in the mast arrangement (18) and through at least one second opening (38) that can be brought into alignment with the first opening (52, 52A) and is formed in the bracket (16), wherein the locking element (54) is connected by means of a connection element (56) to an actuation element (58) arranged offset parallel to the locking element (54), and wherein the actuation element (58) can be actuated by an external force and the locking element (54) can be displaced longitudinally by means of the connection element (56) and through actuation of the actuation element (58) from the unlocked position into the locked position; and a latching device (59) with which the actuation element (58) can be latched in the unlocked position, wherein the latching device (59) comprises a latching lever (64) that is supported on the mast arrangement (18) and can be forced by a second spring (68) into a latched position in which the latching lever (64) can be brought into engagement in an unlocked position with a shoulder (86) formed on the actuation element (58), and wherein the latching lever (64) has an actuation face (74) that can be brought into engagement with the bracket (16) such that the latching lever (64) is moved out from the latched position against an actuating force of the spring (68).

2. Front-loader arrangement (12) according to claim 1, wherein the actuation element (58) and the locking element (54) are supported displaceably on the mast arrangement (18), and wherein the locking element (54) is displaced together with the actuation element (58) when the actuation element (58) is displaced.

3. Front-loader arrangement (12) according to claim 1, further comprising a first spring (84) through which the actuation element (58) can be actuated.

4. Front-loader arrangement (12) according to claim 3, wherein the first spring (84) provided for actuation of the actuation element (58) is a coil spring.

5. Front-loader arrangement (12) according to claim 1, wherein the actuation element (58) and the locking element (54) are formed as round bolts.

6. Front-loader arrangement (12) according to claim 5, wherein, for the detachment of the front loader (13) from the bracket (16), the actuation element (58) is supported displaceably in a guide opening (76) formed in the mast arrangement (18) such that, in an unlocked position, the latching lever (64) can be brought into engagement with the shoulder (86) of the actuation element (58) in a position engaged with its actuation face (74) with the bracket (16).

* * * * *